US006293571B1

(12) United States Patent
Wen

(10) Patent No.: US 6,293,571 B1
(45) Date of Patent: Sep. 25, 2001

(54) SKATEBOARD

(76) Inventor: Yi-Ling Wen, 2Fl., No. 21, Chung-Hsin Rd., Fengyuan City, Taichung Hsien (TW)

( * ) Notice: Subject to any disclaimer, the term of this patent is extended or adjusted under 35 U.S.C. 154(b) by 0 days.

(21) Appl. No.: 09/617,262

(22) Filed: Jul. 17, 2000

Related U.S. Application Data

(63) Continuation-in-part of application No. 09/213,275, filed on Dec. 17, 1998, now abandoned.

(51) Int. Cl.[7] ..... A63C 17/02
(52) U.S. Cl. ..... 280/87.042
(58) Field of Search ..... 280/87.041, 87.042, 280/842, 609, 610, 18, 14.21

(56) References Cited

U.S. PATENT DOCUMENTS 3,736,609 * 6/1973 Saucier ..... 280/610 X
4,182,520 * 1/1980 Stevenson ..... 280/87.042
4,337,963 * 7/1982 Stevenson ..... 280/87.042
5,232,235 * 8/1993 Brooks ..... 280/87.042
5,267,743 * 12/1993 Smisek ..... 280/87.042
5,673,926 * 10/1997 Gauer ..... 280/610

OTHER PUBLICATIONS cycle, Unholy Rollers, By John Burns, p. 48, lines 32–33.*

* cited by examiner

*Primary Examiner*—Michael Mar
(74) *Attorney, Agent, or Firm*—Rosenberg, Klein & Lee

(57) ABSTRACT

A skateboard includes an elongated body having a top plate, a bottom plate and two opposite closed side plates each located between the top plate and the bottom plate, a support base formed on the mediate portion of the top plate, a plurality of reinforcing ribs each longitudinally arranged in the elongated body and each supported between the top plate and the bottom plate, two strengthened frames each longitudinally arranged in the elongated body located adjacent to the support base, and each supported between the top plate and the bottom plate, and a foam core material inside the elongated body located between the strengthened frames and the reinforcing ribs.

2 Claims, 5 Drawing Sheets

SKATEBOARD

CROSS-REFERENCE TO RELATED APPLICATION

The present invention is a continuation-in-part (CIP) application of the U.S. Ser. No. 09/213/275, filed on Dec. 17, 1998 now abandond.

BACKGROUND OF THE INVENTION

1. Field of the Invention

The present invention relates to a skateboard.

2. Description of Related Art

A first conventional skateboard in accordance with the prior art shown in FIG. 3 comprises an elongated solid body (40) made of plastic by means of an injection molding process, two support brackets (41) each secured on one of the two end portions of the elongated body (40) and each having two wheels (42) each rotatably mounted on one of the two end portions thereof. However, the solid body (40) is heavy, thereby decreasing its portability and increasing the cost of manufacturing. In addition, the solid body (40) lacks flexibility and elasticity, thereby reducing the manipulation and movement of the skateboard. Moreover, the elongated body (40) made of plastic cannot be reused when it is worn out.

A second conventional skateboard in accordance with the prior art shown in FIGS. 4 and 5 comprises an elongated sheet-shaped body (50) made of an alloy, a reinforcing frame (52) secured on the bottom of the body (50), two support brackets (52) each secured to one of the two end portions of the reinforcing frame (51) and each having two wheels (54) each rotatably mounted on one of the two end portions thereof. However, the sheet-shaped body (50) is weak and is easily deformed when hit by foreign objects.

The present invention has arisen to mitigate and/or obviate the disadvantage of the conventional skateboards.

SUMMARY OF THE INVENTION

In accordance with one aspect of the present invention, there is provided a skateboard comprising an elongated body including a top plate, a bottom plate and two opposite closed side plates each located between the top plate and the bottom plate, and a plurality of reinforcing ribs each longitudinally arranged in the elongated body and each supported between the top plate and the bottom plate.

The elongated body includes a support base formed on the mediate portion of the top plate thereof, and the skateboard comprises two strengthened frames each longitudinally arranged in the elongated body located adjacent to the support base, and each supported between the top plate and the bottom plate. Preferably, the elongated body, the reinforcing ribs and the strengthened frames are integrally made of an aluminum alloy.

The skateboard further comprises a foam core material inside the elongated body located between each of the strengthened frames and reinforcing ribs. The skateboard further comprises two flexible protective pads each secured on one of the two end portions of the elongated body.

Further benefits and advantages of the present invention will become apparent after a careful reading of the detailed description with appropriate reference to the accompanying drawings.

DETAILED DESCRIPTION OF PREFERRED EMBODIMENT

Figure 1:
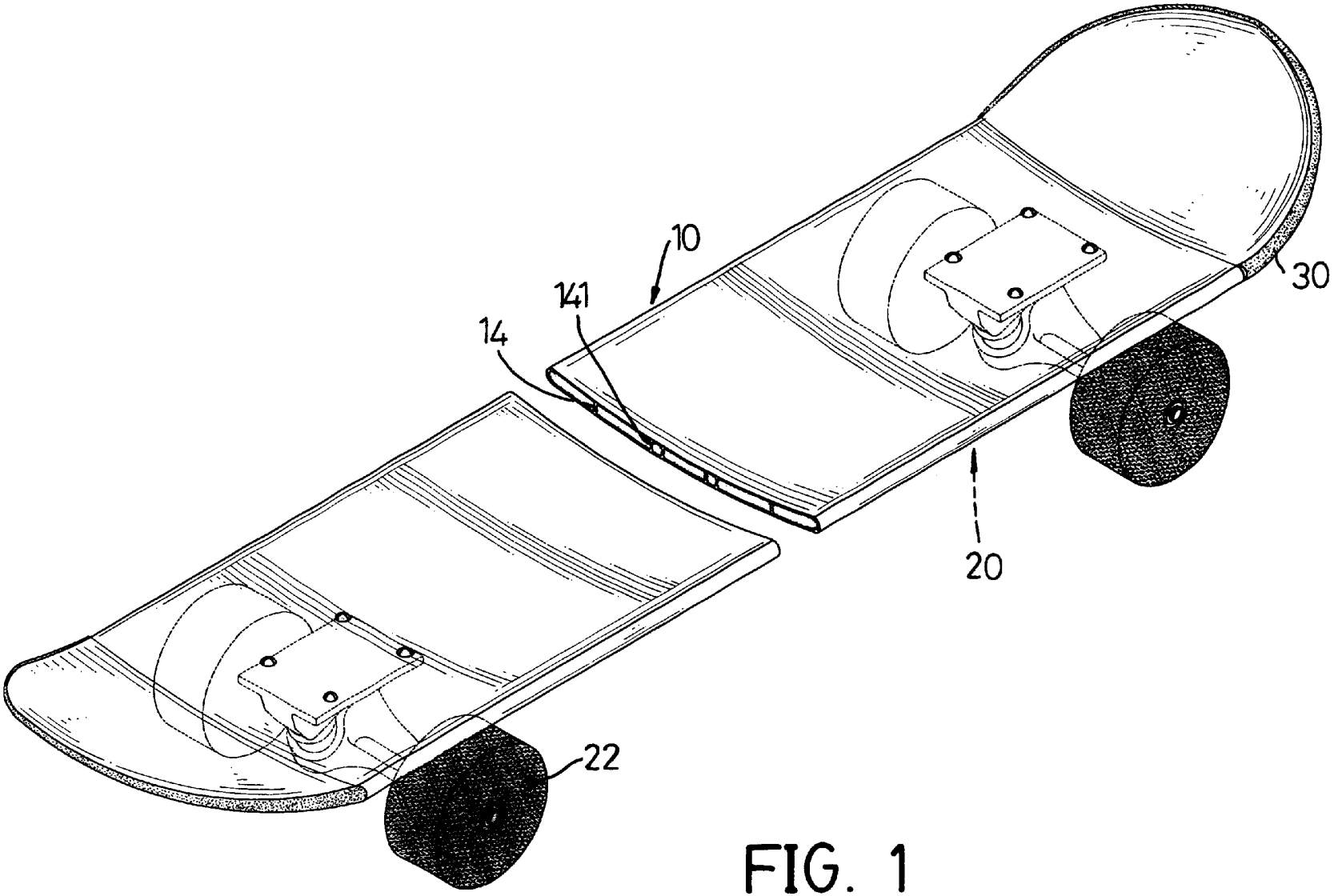
FIG. 1 is a perspective view of a skateboard in accordance with the present invention.
Figure 2:
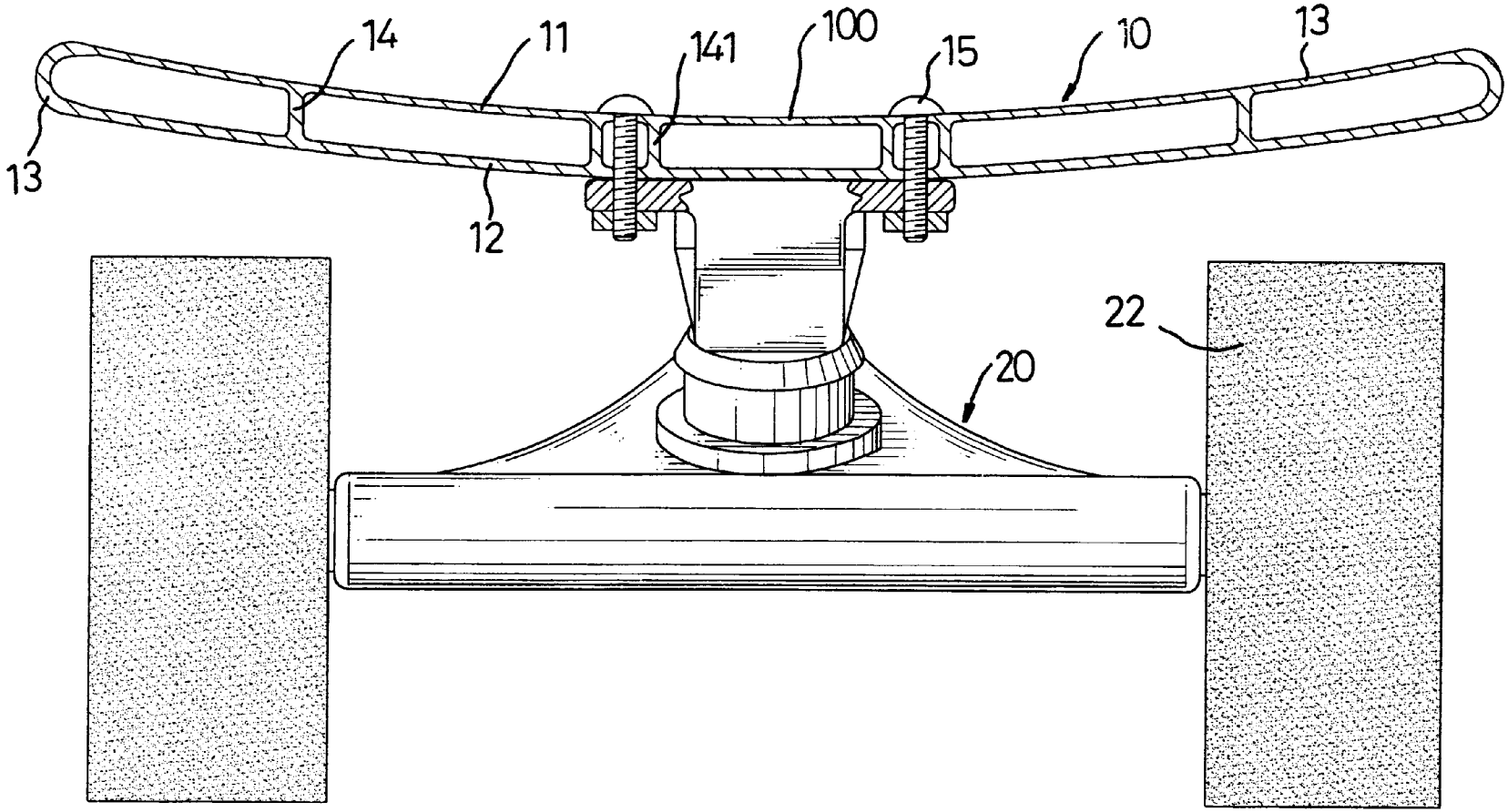
FIG. 2 is a front plan view in partial section of the skateboard as shown in FIG. 1.
Figure 3:
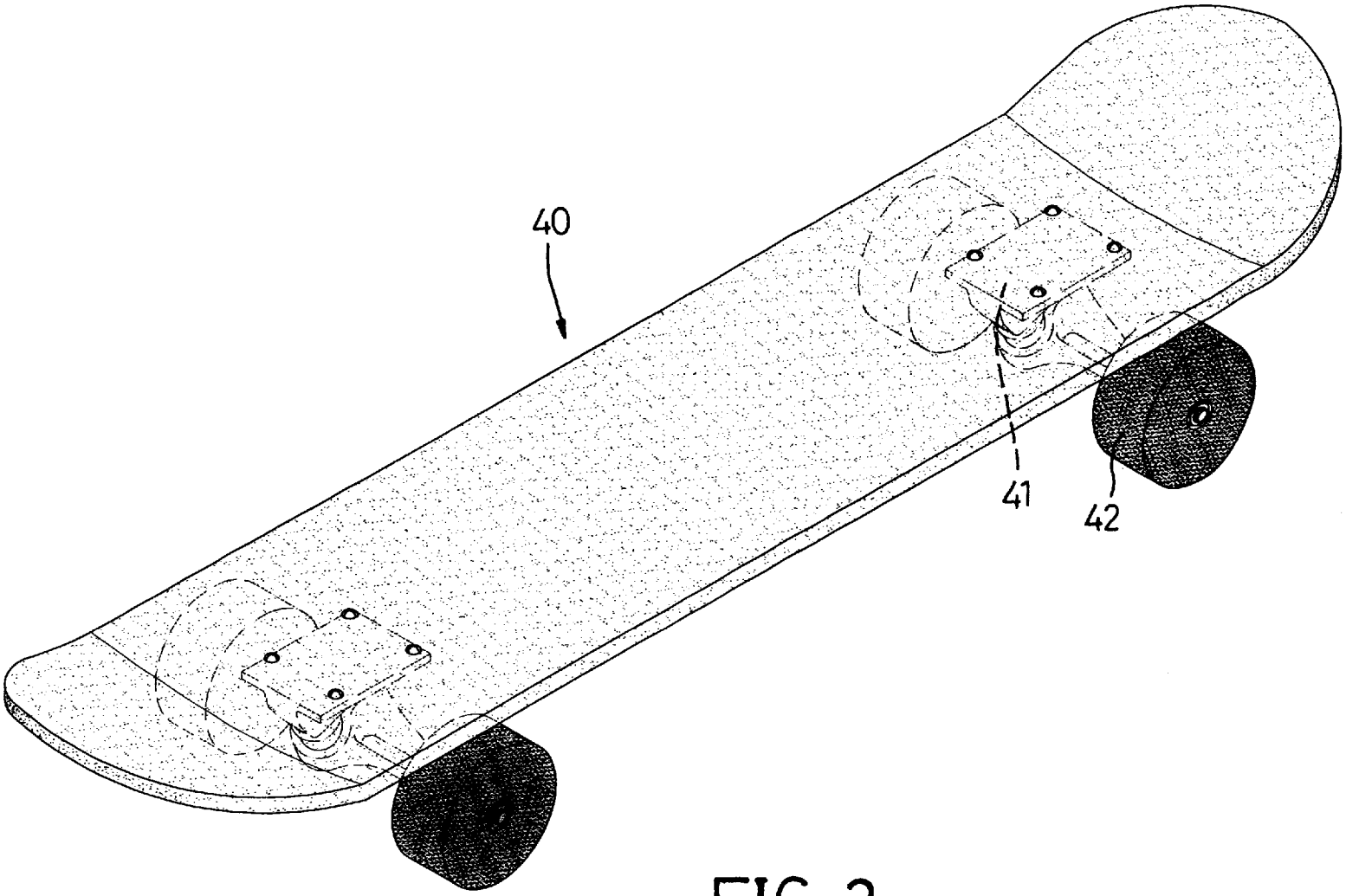
FIG. 3 PRIOR ART
FIG. 3 is a perspective view of a first conventional skateboard in accordance with the prior art.
Figure 4:
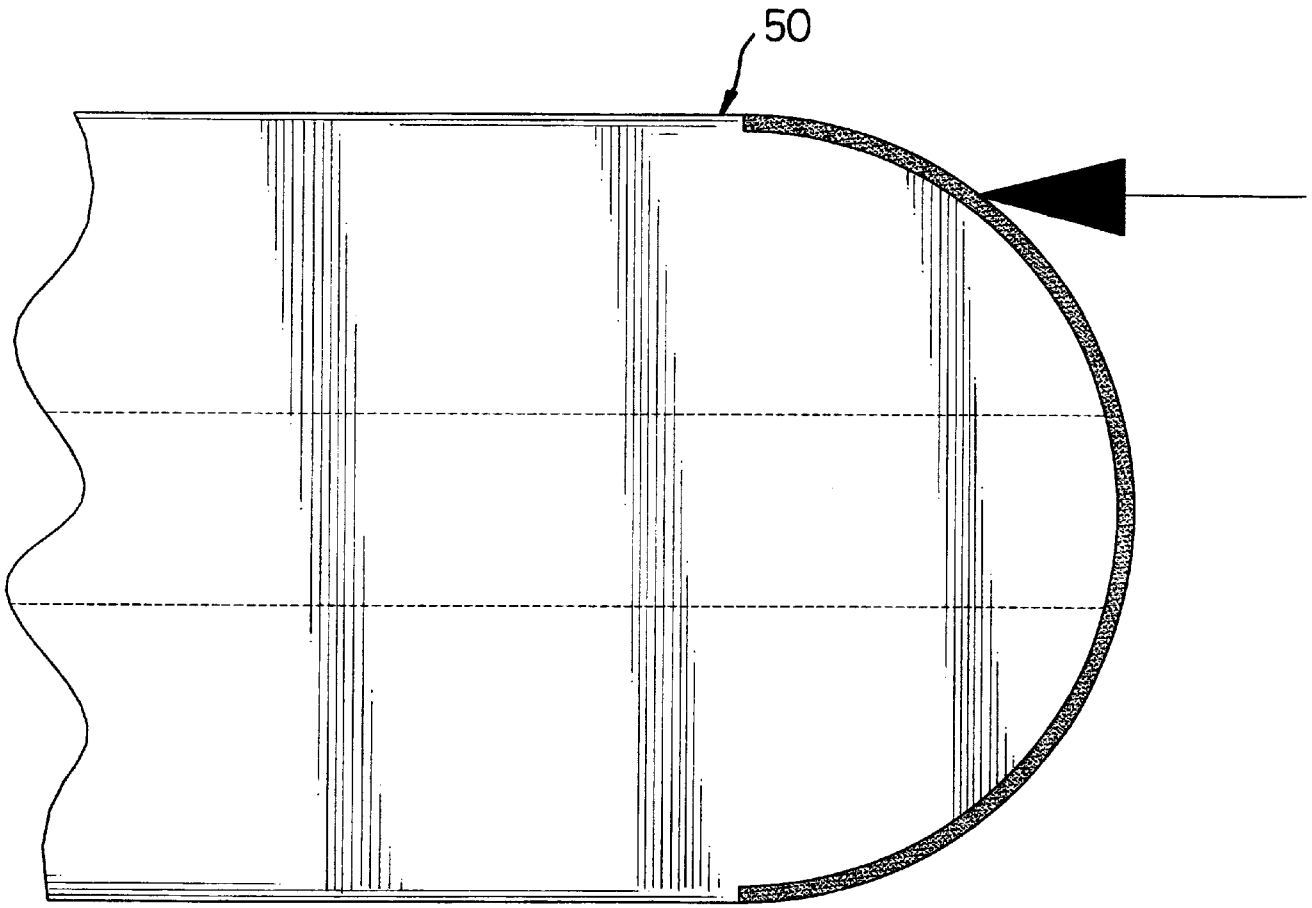
FIG. 4 PRIOR ART
FIG. 4 is a partial top plan view of a second conventional skateboard in accordance with the prior art.
Figure 5:
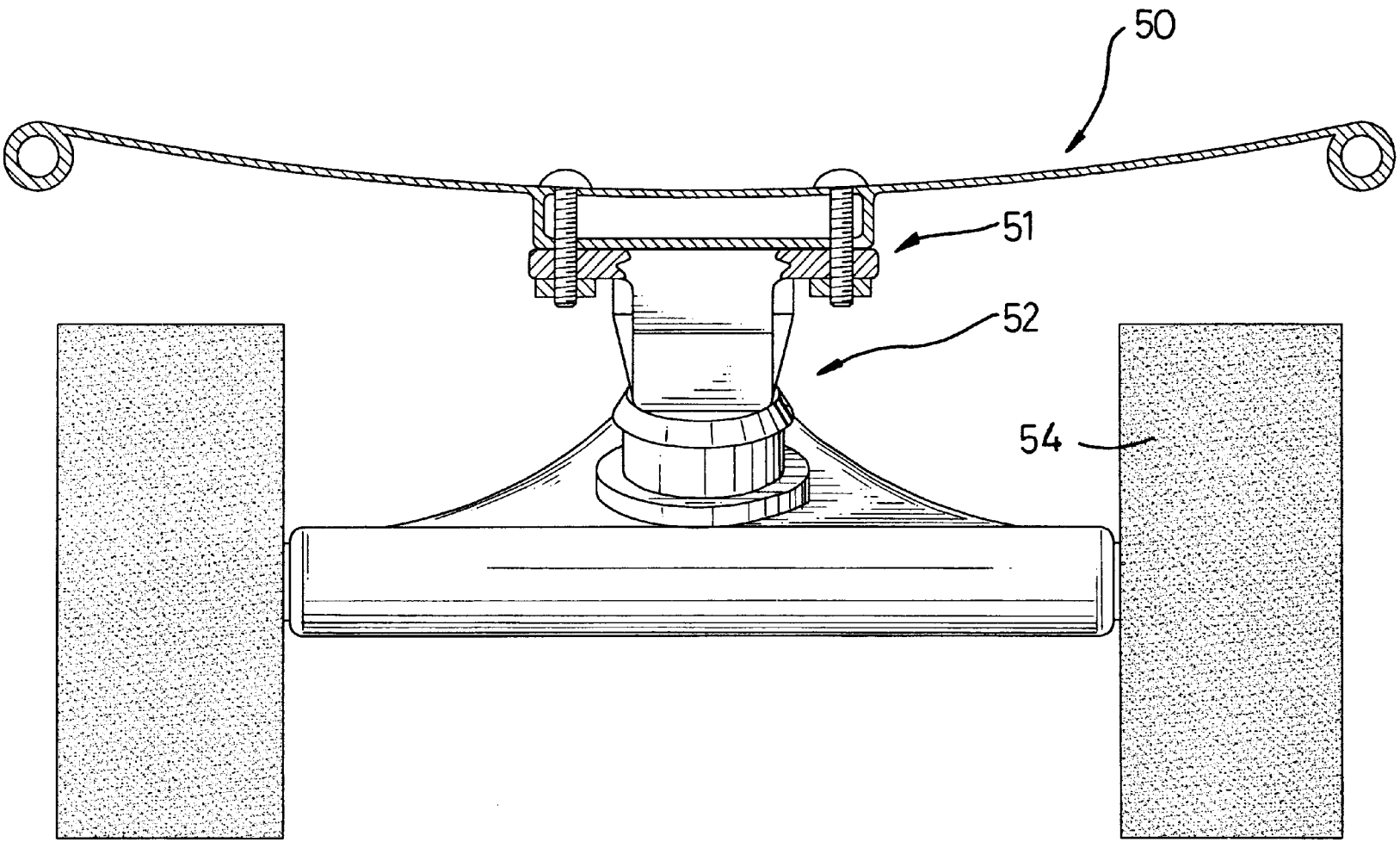
FIG. 5 PRIOR ART
FIG. 5 is a front plan view in partial section of the skateboard as shown in FIG. 5.

Referring now to FIGS. 1–2, a skateboard in accordance with the present invention comprises an elongated hollow body (10) including a top plate (11), a bottom plate (12) and two opposite closed side plates (13) each located between the top plate (11) and the bottom plate (12), two support brackets (20) each secured on one of the two end portions of the bottom plate (12) of the elongated body (10) by means of four bolts (15) and each having two wheels (22) each rotatably mounted on one of the two end portions thereof, and two flexible protective pads (30) each secured on one of the two end portions of the elongated body (10).

The skateboard further comprises a plurality of reinforcing ribs (14) each longitudinally arranged in the elongated body (10) and each formed between the top plate (11) and the bottom plate (12).

The elongated body (10) includes a support base (100) formed on the mediate portion of the top plate (11) thereof, and the skateboard further comprises two strengthened frames (141) each longitudinally arranged in the elongated body (10) adjacent to the support base (100), and each formed between the top plate (11) and the bottom plate (12). Bolts (15) respectively extend through the strengthened frames (141). The elongated body (10), the reinforcing ribs (14) and the strengthened frames (141) are integrally made of single moldable material, such as an aluminum alloy.

In such a manner, the elongated body (10) is made hollow, thereby greatly reducing the weight thereof so as to increase its portability and to decrease the cost of fabrication. In addition, the elongated body (10) is both flexible and elastic due to its hollow design. Further, the elongated body (10) is made very strong by means of the reinforcing ribs (14) and the strengthened frames (141) such that it is not easily deformed when it hits or is hit by foreign objects. Moreover, the elongated body (10) is integrally made of an aluminum alloy such that it can be recycled after being worn out.

It should be clear to those skilled in the art that further embodiments may be made without departing from the scope and spirit of the present invention.

What is claimed is:

1. A skateboard comprising;

at least two wheel assemblies, each wheel assembly including a pair of wheels rotatably mounted to a support bracket;

an elongated hollow body formed by a top plate, a bottom plate, and a pair of closed side plates disposed along opposing lateral sides of said body, each of said pair of closed side plates being formed between said top plate and said bottom plate, said top plate forming a support base which includes a longitudinally extending central portion and lateral side portions curving upwardly from said central portion;

two pairs of laterally spaced frame members formed between said top plate and said bottom plate and extending longitudinally within said elongated body below said central portion, said elongated body being configured for receiving a plurality of bolts extending through both said top plate and said bottom plate and between respective pairs of said frame members with lower ends of said bolts extending through said support brackets for coupling said wheel assemblies to said elongated body; and a pair of reinforcing ribs formed between said top plate and said bottom plate, each reinforcing rib extending longitudinally within said elongated body in a portion thereof between a respective one of said two pairs of frame members and a respective one of said pair of closed side plates, wherein said elongated body, said two pairs of frame members, and said pair of reinforcing ribs are integrally formed in one piece of a single moldable material.

2. The skateboard in accordance with claim 1, wherein said elongated body, said reinforcing ribs and said frame members are integrally made of an aluminum alloy.

* * * * *